US005181475A

United States Patent [19]

Breen et al.

[11] Patent Number: 5,181,475

[45] Date of Patent: Jan. 26, 1993

[54] APPARATUS AND PROCESS FOR CONTROL OF NITRIC OXIDE EMISSIONS FROM COMBUSTION DEVICES USING VORTEX RINGS AND THE LIKE

[75] Inventors: Bernard P. Breen, Pittsburgh, Pa.; James E. Gabrielson, Plymouth, Minn.

[73] Assignee: Consolidated Natural Gas Service Company, Inc., Pittsburgh, Pa.

[21] Appl. No.: 829,430

[22] Filed: Feb. 3, 1992

[51] Int. Cl.[5] ..... F23D 11/00; F23D 15/00

[52] U.S. Cl. ..... 110/345; 110/212; 110/213; 110/214; 422/182

[58] Field of Search ..... 110/212, 213, 345, 214; 422/182

[56] References Cited

U.S. PATENT DOCUMENTS

| | | | |
|---|---|---|---|
| 3,567,399 | 3/1971 | Altmann et al. | 110/213 X |
| 4,542,703 | 9/1985 | Przewalski | 110/213 X |
| 4,597,342 | 7/1986 | Green | 110/347 |
| 4,779,545 | 10/1988 | Breen et al. | 110/212 |
| 4,790,743 | 12/1988 | Leikert et al. | 431/8 |
| 4,941,415 | 7/1990 | Pope et al. | 110/213 X |

OTHER PUBLICATIONS

European Patent Application No. 0 280 568 to Masai Feb. 1987.

*Primary Examiner*—Edward G. Favors

*Attorney, Agent, or Firm*—Buchanan Ingersoll; Lynn J. Alstadt

[57] ABSTRACT

An apparatus and method for reducing nitrogen oxide emissions from the products of combustion is provided in which a vortex generator introduces natural gas, or other fluid fuel into the upper portion of a combustion device. The fuel introduced forms vortices, such as vortex rings, and the fuel reacts with the nitrogen oxide in the combustion products to form ammonia-like compounds, hydrogen cyanide and similar compounds, and nitrogen. The ammonia and cyanide-like fragments react with additional amounts of nitrogen oxide in the combustion products to form nitrogen gas, water vapor and carbon dioxide. The vortex rings can be controlled and will maintain their integrity longer than puffs or simple jets of fuel.

22 Claims, 1 Drawing Sheet

APPARATUS AND PROCESS FOR CONTROL OF NITRIC OXIDE EMISSIONS FROM COMBUSTION DEVICES USING VORTEX RINGS AND THE LIKE

BACKGROUND OF THE INVENTION

1. Field of the Invention

The present invention relates to an apparatus and method for the in-furnace reduction of nitrogen oxide emissions in flue gas using natural gas and/or other fuels as the reducing agent.

2. Description of the Prior Art

In the combustion of fuels with fixed nitrogen such as coal, oxygen from the air may combine with the nitrogen to produce nitrogen oxides. At sufficiently high temperatures, oxygen reacts with atmospheric nitrogen to form nitrogen oxides. Production of nitrogen oxide is regarded as undesirable. Nitrogen oxides are toxic, they contribute to acid rain and can make rain, dew and mist corrosive. There are numerous government regulations which limit the amount of nitrogen oxide which may be emitted from a combustion furnace. Consequently, there is a need for apparatus and processes which reduce the nitrogen oxide emissions in furnace flue gas.

Numerous attempts have been made to develop apparatus and processes which reduce the nitrogen oxide emissions in a furnace flue gas. One such approach is a process known as in-furnace nitrogen oxide reduction, reburning, or fuel staging. In reburning, coal, oil, or gas is injected above the normal flame zone to form a fuel-rich zone. In this zone, part of the nitrogen oxides are reduced to ammonia and cyanide-like fragments and $N_2$. Subsequently, air is injected to complete combustion. The reduced ammonia and cyanide-like fragments are then oxidized to form $N_2$ and nitrogen oxide.

Several problems occur when this process is used. First, coal may be an inefficient reburn fuel because of its high fixed-nitrogen composition. Within any furnace there are wide temperature zones in which fuel nitrogen will convert to nitrogen oxide. Thus, the fixed nitrogen reduced from the coal has a chance of. ending up as nitrogen oxide.

Furthermore, the fuel must be injected with a sufficient volume of gas. If air or flue gas containing oxygen is used as this carrier gas, there must be enough fuel to consume the oxygen in the carrier, and to supply an excess of fuel so reducing conditions exist. This increases the amount of fuel which must be used as reburn fuel. Furthermore, the necessity of using carrier air requires extensive duct work in the upper part of the furnace.

Additionally, the reburn fuel must be injected well above the primary combustion zone of the furnace so that it will not interfere with the reactions taking place therein. However, this fuel must be made to burn out completely without leaving a large amount of unburned carbon. To do this, the fuel must be injected in a very hot region of the furnace some distance from the furnace exit. The exit temperature of the furnace must be limited in order to preserve the heat exchangers, surface. Therefore, a tall furnace is required to complete this second stage process.

Moreover, the fuel must be injected in such quantities as to make the upper furnace zone fuel rich. This fuel is supplied in excess to the amount of air in the furnace and ultimately requires more air in order to be completely combusted. Thus, air must be injected above the reburn fuel injection. This requires even more duct work and furnace volume.

Finally, most coal furnaces which are now in operation are not designed to accommodate the prior art methods. Major modifications such as the provision of extensive ductwork and the addition of a second stage to the process are required to utilize the prior art method. Such retrofitting is expensive. Consequently, there is a need for a combustion apparatus and process which will reduce nitrogen oxide emissions in flue gas and which can be readily used in existing furnaces.

In our U.S. Pat. No. 4,779,545, a reburn process is disclosed wherein natural gas is introduced into the upper furnace through pulse combustors. The patent teaches that the natural gas must be injected in pulses to achieve $NO_x$ reduction. This process does not require any carrier air or flue gas for $NO_x$ reduction. However, it does require the expense of obtaining and operating pulse combustors and some air may be required. Therefore, there is a need for an improved process for in-furnace reduction of nitrogen oxides which can be implemented at low cost.

In our U.S. patent application Ser. No. 608,718, we disclose an apparatus and process for reducing nitrogen oxide which employs pipes, orifices and nozzles to introduce reburn fuel into the upper part of the furnace with sufficient turbulence to cause rapid mixing. In our U.S. patent application Ser. No. 623,782, an apparatus and a process is disclosed wherein pipes, orifices, nozzles, diffusers, ceramic socks and porous ceramic bodies are employed to allow the reburn fuel to diffuse slowly into the flue gas. Although these techniques work they cannot be precisely controlled. We have now discovered that fuel injected in the form of vortices, such as vortex rings, can be directed and controlled so the maximum reduction of nitrogen oxide can be obtained.

SUMMARY OF THE INVENTION

In accordance with the present invention, there is provided an improved apparatus and process for the control of nitrogen oxide emissions in combustion products. This is accomplished by injecting vortices of a combustible fluid into flue gas. We prefer to provide vortex ring generators to introduce the combustible fluid such as natural gas into combustion products after the most vigorous combustion is complete and some heat has been lost to the surroundings. Our preferred vortex ring generators are driven by small reciprocating pistons or adjustable diaphragms which expel rings of the combustible fluid through small orifices into the combustion products. No dilution fluid is needed and so no duct work is needed to bring air nor flue gas to the upper part of the combustion device. Vortex rings of natural gas or other fuel are introduced periodically into the upper section of the furnace. These vortices slowly mix with air rich combustion products coming from the coal, oil or gas burners in the furnace. The vortex rings of fuel entrain portions of the air rich combustion products and process these portions of air rich combustion products through a fuel rich environment. In this fuel rich environment the nitrogen oxide formed in the coal, oil or gas burners will be reduced to ammonia and cyanide-like moieties and $N_2$. As the vortex continues to move through the products of combustion it continuously entrains flue gas in front and continuously rejects gas to the region behind the ring. The rejected gas is fuel rich and contains reduced nitrogen compounds. This rejected fuel rich gas will continue to reduce nitrogen oxide contained in air rich combustion products with which it mixes. However, as the rejected material mixes with more and more air rich combustion products it passes into an air rich environment. At that point the reduced nitrogen, ammonia and cyanide-like moieties, react with nitrogen oxide in the air rich gas to form nitrogen. Excess fuel will react with excess oxygen in the air rich combustion gases.

The system is simple which makes it ideal for retrofitting existing coal, oil and gas fired combustion devices. The process produces fuel rich vortices which mix slowly with the surrounding air rich combustion products. Because of this sequential mixing there is no requirement for an air addition stage. Because the natural gas and other volatile fuels continue to burn more rapidly at lower temperatures than possible with oil, coal, or other solid fuels, the reburn fuel can be introduced at a location more remote from the primary burners and at a lower temperature than could other reburn fuels. At lower temperatures the nitrogen oxide equilibrium is reduced and the possible reduction of nitrogen oxide is increased. The vortex ring offers a more controlled mixing than other introduction devices such as pulse burners, continuous burners or steady gaseous jets. Ductwork to convey carrier air or flue gas to the fuel injection point is not required. As a result, the cost of lowering the nitrogen oxide emissions is greatly reduced. Other advantages will become apparent from the description of the preferred embodiments.

DESCRIPTION OF THE PREFERRED EMBODIMENT

Figure 1:
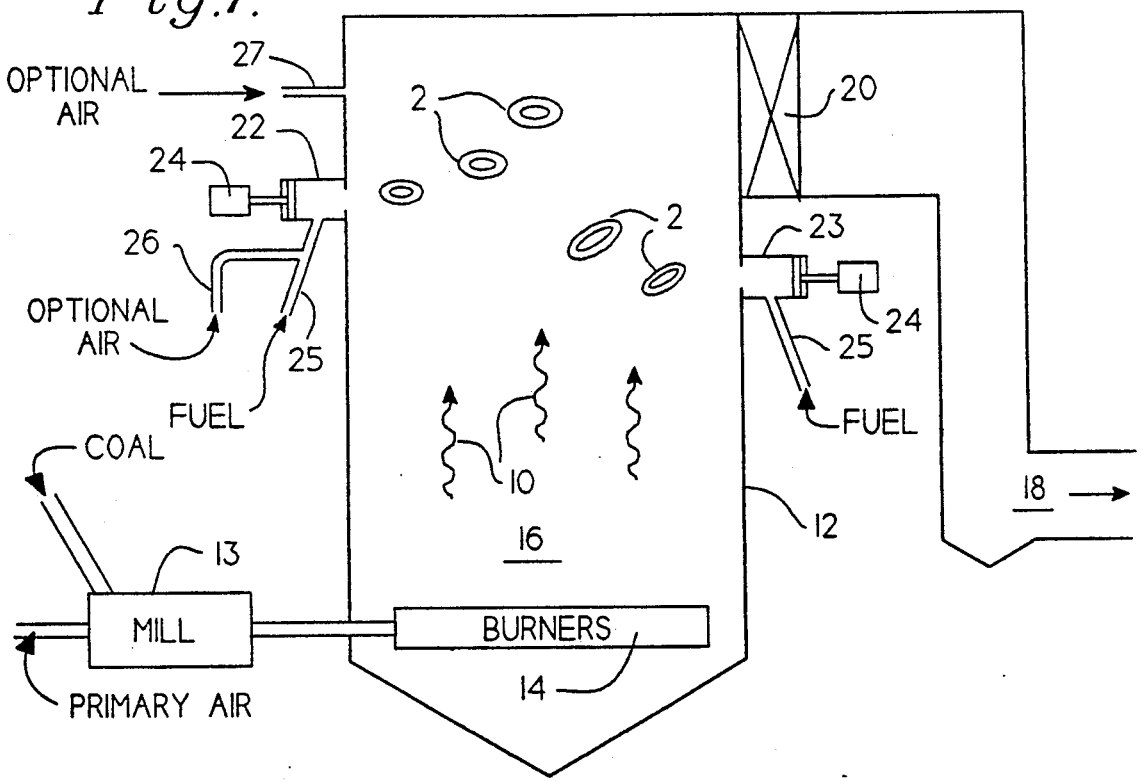
FIG. 1 is a schematic of an apparatus for reducing nitrogen oxide emissions in accordance with the principles of the present invention.

As shown in FIG. 1, our improved apparatus for reducing nitrogen oxide emissions in combustion products 10 can be readily retrofitted to a combustion device such as an existing furnace 12. The furnace 12 is designed to utilize coal or any other fuel. The fuel enters the combustion device from mills 13 through burners 14 which are shown here in the lower portion of the combustion device 12. The fuel burns in the primary combustion zone 16 of the device within which temperatures are typically in excess of 3000° F. Combustion products 10 flow upward from the combustion zone 16, past heat exchanger 20, through ductwork 18 and out of the furnace. The flue gas has a temperature of 1800° to 2500° F. when it exits the furnace near the heat exchanger 20. Heat exchangers 20 in the upper portion of the furnace cause the temperature in the flue gas to drop very rapidly and any unburned fuel which enters these heat exchangers usually will be wasted and will exit the furnace as hydrocarbon emissions. During the combustion of the fuel, some of the fuel bound nitrogen will react with oxygen to form $NO_x$ and some $NO_x$ will be formed from atmospheric nitrogen and oxygen.

We are able to reduce the $NO_x$ by injecting vortices of fuel into the combustion device 12 between combustion zone 16 and heat exchanger 20. In FIG. 1, we provide vortex generators 22 and 23 to reduce the nitrogen oxide emissions in the combustion products. These generators are driven by a reciprocating piston or diaphragm 34. A combustible fuel such as natural gas enters the vortex generators 22 and 23 through input 25. If desired, air or combustion products can be added to this fuel through optional conduit 26. One could also inject air through injector 27 attached to the furnace above the vortex ring generator 22. The vortex ring generators 22 and 23 introduce vortex rings 2 of natural gas or other fuel into the upper portions of the furnace 12 above the primary combustion zone 16. As the vortex rings 2 travel through the combustion device 12, they will react with the combustion products 10 in the manner hereinafter described to reduce $NO_x$.

Figure 2:
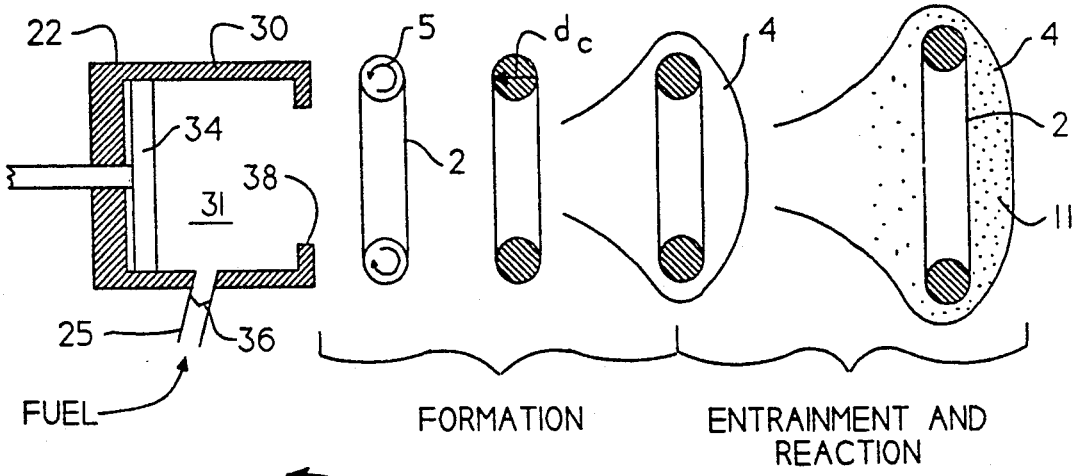
FIG. 2 is a side view partially in section of a present preferred vortex ring generator and four vortex rings generated therefrom.

As shown in FIG. 2, a vortex ring 2 is a toroid or donut shape which is generated by forcing units of fuel through an orifice 38. In the vortex ring generator 22 shown in FIG. 2, we provide a housing 30 which defines a chamber 31. A piston or diaphragam 34 is provided in the chamber 31 which is driven by a motor or pump 24 shown in FIG. 1. As the piston 31 moves to its seated position shown in FIG. 2, a fuel such as natural gas is drawn into chamber 31 through conduit 25. Then a valve 36 closes in conduit 25 and piston 34 moves forward in chamber 31. This forces fuel in the chamber 31 to pass through orifice 38. The fuel will exit initially as a bulge which develops into a vortex ring 2. The fuel within each vortex ring will be swirling in the direction indicated by arrow 5. One may choose to mix air or combustion products with the natural gas in order to tailor the size and composition of the rings for a specific furnace. Usually, the ring will start as gaseous fuel or as almost all gaseous fuel. In addition to natural gas there are fuels of the general formulas $C_xH_y$ and $C_xH_yO_z$ which usually contain little or no fixed nitrogen. Mixtures of compounds included in these general categories can also be used in this process. As the vortex rings 2 move through the combustion device 12, they will entrain combustion products 11 and reject fuel rich gas volumes within an interface or mixing zone 4 around the vortex ring 2. This mixing will continue until the vortex ring dies out or has processed so much air rich flue gas that it is no longer fuel rich. As the flue gas mixes into a fuel rich vortex the fuel reduces the $NO_x$ to ammonia and cyanide-like fragments as well as to nitrogen. This fuel rich volume also contains combustion products and reduced nitrogen species. They mix with more oxygen containing combustion products, either by being rejected behind the moving vortex and mixing with an excess of flue gas or by remaining in the vortex until it has finally ingested enough combustion products that the whole of the vortex becomes oxidizing. The oxygen reacts with the remaining fuel while the ammonia and cyanide like fragments react with the $NO_x$ in the combustion products to form nitrogen.

In every furnace there will be regions in which $NO_x$ is produced and regions where $NO_x$ can be eliminated through the chemical reactions just described. It is important to be able to assure that sufficient amounts of the injected fluid reach these zones to achieve the desired result. Vortices are more stable and controllable than pulses of fuel. Indeed, one can measure and predict whether certain vortices will reach the desired regions. If a given vortex is found not to be effective one can change its size and composition until a suitable vortex is created. The frequency of the piston strokes, the length of the stroke, the velocity or velocity variations of the piston during the stroke, the piston diameter, and the orifice diameter can each be selected independently of the others. The devices can be constructed so that stroke frequency and length can be adjusted as needed by the dictates of the process. Larger orifices result in the greatest penetration. The penetration is maximized if the orifice diameter times $\pi$ (3.1416) is equal to two times the slug length. The penetration is maximized if the perimeter of the slug is equal to twice its length. The slug length is derived from the stroke length and the piston and orifice diameters. When these two factors are equal, the core diameter $d_c$ is the greatest and the penetration is the greatest. The core diameter is the small diameter of the ring as shown in FIG. 2.

To illustrate the control parameters, consider a furnace for which it is determined that the vortex must travel at least 13 feet through the flue gas. Therefore, we decide to produce a turbulent ring by expelling a slug thorugh a three-inch diameter orifice. For maximum penetration, the equivalent slug length should be one half of the orifice perimeter or one half of $\pi$(3.1414) times the diameter. The perimeter of a three-inch diameter orifice is 9.42 inches and the slug length should be 4.71 inches. The slug volume would be $(\pi D^2/4)L$, the area of the orifice times the desired slug length or 33.28 cubic inches. If a piston with a three-inch diameter should have a stroke of 4.71 inches, a piston with a diameter of 1.5 inches should have a stroke of 18.48 inches. With the stroke being accomplished in 17 milliseconds, the vortex would retain 30% of its initial velocity until it has progressed 13 feet.

The natural gas vortex ring, as it mixes with the air rich combustion products and begins to burn, reacts with a portion of the nitrogen oxide in the flue gas to form molecular nitrogen, $N_2$, ammonia, $NH_3$, ammonia fragments, $NH_i$, cyanide, $H_iCN$, and cyanide-like fragments, $H_iCN$:

$$r_1\ CH_4 + r_1\ NO_x = P_1\ N_2 + P_2\ NH_i + P_3\ H_iCN + P_4\ H_2O \quad (1)$$

As the vortex ring or parts of it mix with more flue gas to complete its combustion, cyanide and similar compounds react with additional nitrogen oxide to form $N_2$, carbon dioxide and water vapor:

$$r_1\ NH_i + r_2\ H_iCN + r_3\ NO_x = P_1\ 2N_2 + P_2\ CO_2 + P_3\ H_2O \quad (2)$$

While these reactions characterize the process, they do not show all the reactions, pathways and intermediate species which may occur.

We introduce the vortex rings of fuel in the upper region of the combustion device where the fuel does not interfere with the combustion of the coal, oil or gas taking place in the lower part of the furnace. Because natural gas or other volatile fuels which are used can be burned at lower temperatures than coal, it can be introduced in the furnace where the temperature is 2000° F. to 2400° F. Since this is frequently the temperature of gas passing from the furnace to the convective heat transfer devices, vortex ring generators 22 and 23 can be located near the furnace exit. The need for second stage combustion air has been eliminated and the use of carrier air or flue gas has been removed. The low temperature reduces the temperature-dependent equilibrium level of nitrogen oxides which allows even greater reduction in the emissions.

This process reduces nitrogen oxide emissions by several methods. First, the natural gas or other preferred hydrocarbons has no fixed nitrogen so no nitrogen oxides are produced from this source. Second, the fuels in the vortex rings are introduced in a location where they mix with gas that has transferred a large amount of its heat to boiler tubes to heat or boil water or to other sinks which surround the combustion device; and therefore, the temperature resulting from the combustion of natural gas in these combustion products is always below 3000° F. and almost no thermal nitrogen oxide will be formed. Third, the natural gas reduces the amount of nitrogen in the flue gas by the chemical reactions set forth in equations (1) and (2) above. Finally, since the natural gas supplies some of the energy for the process, the amount of coal or other fuel burned in the main burners can be reduced. It is well known that a reduction in the fuel flow to the primary combustion zone of a furnace will usually reduce the nitrogen oxide emissions per unit of fuel burned.

Our vortex ring generators are driven by mechanical pistons (or other devices) which expel the natural gas through an orifice. No carrier air is needed. The extensive duct work needed for carrier air or flue gas in other reburn systems is not required for the implementation of this invention. The major retrofitting problem of providing space for the carrier air will not be a problem for this invention. Also, no burn out air is required for this process since only part of any cross section will be made fuel rich.

The vortex ring device is also superior to the pulse generators or steady state gaseous medium and introduction devices since the amount of fuel introduced through a vortex ring generator and the depth of penetration before complete mixing occurs can be completely decoupled. Pulse generators have their own natural frequencies and are not completely controllable. With pipes, jets and annuli and other such devices there is a fixed relationship between the cross section of the injection device, the velocity, the volume of natural gas injected per unit time, and thus the penetration distance.

Our process is also more economical and more flexible than current methods of in-furnace $NO_x$ reduction.

Figure 3:
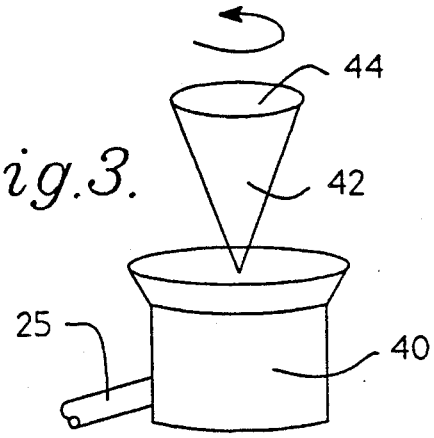
FIG. 3 is a perspective view of a preferred conical type vortex generator and a vortex generated therefrom.

Although the vortex ring is the present preferred form in which the combustible fluid is injected, other vortices can be used. In FIG. 3 we provide an injector 40 which receives combustible fluid through conduit 25 and produces conical vortices 42. In these vortices the combustible fluid swirls about an eye 44. As this conical vortex passes through the flue gas it entrains and reacts with the flue gas in much the same way as the vortex ring.

Figure 4:
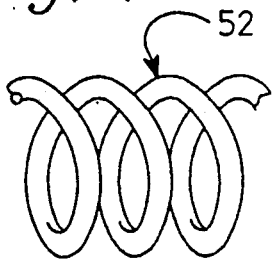
FIG. 4 is a perspective view of a helix type vortex.

Another suitable vortex form is the helix vortex 52 shown in FIG. 4. In this structure the combustible fluid swirls around within the helix. As the helix moves through the furnace it will entrain and react with the flue gas in much the same way as the vortex ring.

While we have shown and described certain present preferred embodiments of the invention it is to be distinctly understood that the invention is not limited thereto, but may be otherwise variously embodied within the scope of the following claims.

We claim:

1. An improved apparatus for reducing nitrogen oxide in the flue gas of a furnace wherein a fuel is burned in a primary combustion zone and produces a flue gas containing nitrogen oxide wherein the improvement comprises:

means forming at least one vortex generator attached to the furnace above the primary combustion zone for generating and injecting into the flue gas a series of vortices which vortices are comprised of a fluid selected from the group of fluids consisting of natural gas, $C_xH_y$ compounds, and $C_xH_yO_z$ compounds.

2. The apparatus of claim 1 wherein said vortex ring generators are positioned to introduce the fluid into a region of said furnace wherein the flue gas is at a temperature of 2000° F. to 2500° F.

3. The apparatus of claim 1 wherein the vortex generators are sized to inject vortices in sufficient size and numbers to promote a reaction of the fluid with a first portion of said nitrogen oxide in said flue gas to form ammonia compounds, cyanide compounds, $N_2$, water and carbon dioxide and said ammonia and cyanide compounds further react with a second portion of said nitrogen oxide in said flue gas to form $N_2$, water, and carbon dioxide.

4. The apparatus of claim 1 wherein the vortex generator generates vortex rings.

5. The apparatus in claim 4 wherein the vortex generator generates vortex rings of a fuel passing through its exit orifice where 3.14 times the orifice diameter is approximately equal to two times the length of an equivalent fluid slug.

6. The apparatus in claim 4 wherein the frequency of formation of vortex rings can be adjusted.

7. The apparatus of claim 4 also comprising means for introducing some air into the vortex rings.

8. The apparatus of claim 1 wherein the vortex generators are capable of introducing between 4 and 25% of the total fuel going to the furnace.

9. The apparatus of claim 1 also comprising at least one air injector attached to the furnace above the vortex ring generators.

10. The apparatus of claim 1 wherein the vortex generator generates conical vortices.

11. The apparatus of claim 1 wherein the vortex generator generates helix vortices.

12. An improved apparatus for reducing nitrogen oxide in the flue gas of a furnace wherein a fuel is burned in a primary combustion zone and produces a flue gas containing nitrogen oxide wherein the improvement comprises:

at least one vortex generator attached to the furnace above the primary combustion zone by means of which vortices comprised of a fluid selected from the group of fluids consisting of natural gas, $C_xH_y$ compounds, and $C_xH_yO_z$ compounds are introduced into the flue gas wherein the vortex generator contains a piston having an adjustable piston stroke.

13. An improved apparatus for reducing nitrogen oxide in the flue gas of a furnace wherein a fuel is burned in a primary combustion zone and produces a flue gas containing nitrogen oxide wherein the improvement comprises:

at least one vortex generator attached to the furnace above the primary combustion zone by means of which vortex rings comprised of a fluid selected from the group of fluids consisting of natural gas, $C_xH_y$ compounds, and $C_xH_yO_z$ compounds are introduced into the flue gas and means for introducing into the vortex rings some flue gas with the fuel.

14. A method of reducing nitrogen oxide emissions in flue gas comprising the step of:

injecting a series of vortices of a fluid selected from the group consisting of natural gas, $C_xH_y$ compounds, $C_xH_yO_z$ compounds, and mixtures primarily of these compounds into the flue gas in sufficient quantities to promote a reaction between the nitrogen oxide in the flue gas and the fluid to form ammonia and cyanide-like compounds and $N_2$ and to promote a secondary reaction of said ammonia and cyanide compounds and additional nitrogen oxide from the fluid gas to form $N_2$, water and carbon dioxide.

15. The method of claim 14 wherein the vortices are introduced at a location where the flue gas has a temperature in the range of 2000° C. to 2400° F.

16. The method of claim 14 also comprising the step of injecting into the vortices air with the fuel.

17. The method of claim 14 wherein the vortices are vortex rings.

18. The method of claim 14 wherein the vortices are conical vortices.

19. The method of claim 14 wherein the vortices are helix vortices.

20. A method of reducing nitrogen oxide emissions in flue gas comprising the step of:

injecting a series of vortices of a fluid selected from the group consisting of natural gas, $C_xH_y$ compounds, $C_xH_yO_z$ compounds, and mixtures primarily of these compounds into the flue gas in sufficient quantities to promote a reaction between the nitrogen oxide in the flue gas and the fluid to form ammonia and cyanide-like compounds and $N_2$ and to promote a secondary reaction of said ammonia and cyanide compounds and additional nitrogen oxide from the flue gas to form $N_2$, water and carbon dioxide and injecting into the vortex rings some flue gas with the fuel.

21. An improved apparatus for reducing nitrogen oxide in the flue gas of a furnace wherein a fuel is burned in a primary combustion zone and produces a stream of flue gas containing nitrogen oxide wherein the improvement comprises:

means forming at least one helix generator attached to the furnace above the primary combustion zone for generating and injecting into the flue gas a helix which penetrates into the stream in a direction nonaligned with a flow of the stream of flue gas and which helix is comprised of a fluid selected from the group of fluids consisting of natural gas, $C_xH_y$ compounds, and $C_xH_yO_z$ compounds.

22. A method of reducing nitrogen oxide emissions in a stream of flue gas comprising the step of:

injecting a series of vortices of a fluid selected from the group consisting of natural gas, $C_xH_y$ compounds, $C_xH_yO_z$ compounds, and mixtures primarily of these compounds into the flue gas in sufficient quantities to promote a reaction between the nitrogen oxide in the flue gas and the fluid to form ammonia and cyanide-like compounds and $N_2$ and to promote a secondary reaction of said ammonia and cyanide compounds and additional nitrogen oxide from the flue gas to form $N_2$, water and carbon dioxide, the helix penetrating the stream of flue gas in a direction nonaligned with a flow of the stream of flue gas.

* * * * *

UNITED STATES PATENT AND TRADEMARK OFFICE

CERTIFICATE OF CORRECTION

PATENT NO. : 5,181,475

DATED : January 26, 1993

INVENTOR(S) : BERNARD P. BREEN, JAMES E. GABRIELSON

It is certified that error appears in the above-identified patent and that said Letters Patent is hereby corrected as shown below:

COlumn 8, claim 15, line 18, change "C." to --F.--.

Column 8, claim 22, line 55, after "a" delete "series of vortices" and insert --helix--.

Column 8, claim 22, line 58, before "flue" insert --stream of--.

Column 8, claim 22, line 60, after "gas" insert --stream--.

Signed and Sealed this

Fifteenth Day of March, 1994

*Attest:*

*Attesting Officer*

Bruce Lehman

BRUCE LEHMAN

*Commissioner of Patents and Trademarks*